US009845173B2

(12) United States Patent
Herman

(10) Patent No.: US 9,845,173 B2
(45) **Date of Patent: *Dec. 19, 2017**

(54) VESSEL AND METHOD FOR MAKING THE SAME

(71) Applicant: COMPLEAT LLC, Boston, MA (US)

(72) Inventor: Peter Herman, Jamaica Plain, MA (US)

(73) Assignee: Compleat LLC, Boston, MA (US)

( * ) Notice: Subject to any disclaimer, the term of this patent is extended or adjusted under 35 U.S.C. 154(b) by 141 days.

This patent is subject to a terminal disclaimer.

(21) Appl. No.: 14/508,339

(22) Filed: Oct. 7, 2014

(65) Prior Publication Data

US 2015/0021382 A1 Jan. 22, 2015

Related U.S. Application Data

(63) Continuation of application No. 13/942,916, filed on Jul. 16, 2013, now Pat. No. 8,864,016, which is a (Continued)

(51) Int. Cl.

| | |
|---|---|
| ***B65D 3/06*** | (2006.01) |
| ***B31B 1/26*** | (2006.01) |
| ***B65D 1/26*** | (2006.01) |
| ***B65D 5/02*** | (2006.01) |
| ***A47G 19/22*** | (2006.01) |
| ***B31B 50/26*** | (2017.01) |

(52) U.S. Cl.

CPC ..... *B65D 3/06* (2013.01); *A47G 19/2205* (2013.01); *B31B 50/26* (2017.08); *B65D 1/265* (2013.01); *B65D 5/0209* (2013.01)

(58) Field of Classification Search

CPC . B65D 3/06; B65D 3/20; B65D 3/268; B65D 5/74; B65D 5/741; B65D 5/0209; (Continued)

(56) References Cited

U.S. PATENT DOCUMENTS

| | | | |
|---|---|---|---|
| 359,435 | A | 3/1887 | Elliott |
| 667,634 | A | 2/1901 | Schmidt |

(Continued)

FOREIGN PATENT DOCUMENTS

| | | | | |
|---|---|---|---|---|
| EP | 1 354 804 | A1 | 10/2003 | ..... B65D 3/20 |
| EP | 1 236 648 | B1 | 6/2006 | ..... B65D 5/02 |

(Continued)

OTHER PUBLICATIONS

Authorized Officers Derbal, Jamel and Galarraga, J., Serrano, Notification of Transmittal of the International Search Report and the Written Opinion of the International Searching Authority, or the Declaration; PCT/US2010/038327 7 pages Sep. 14, 2010.

(Continued)

*Primary Examiner* — Christopher Demeree

(74) *Attorney, Agent, or Firm* — Sunstein Kann Murphy & Timbers LLP

(57) ABSTRACT

A vessel composed of a sheet of flexible material, cut, rolled, and affixed to form a frusto-conically shaped base region. The sheet when rolled including an upper region having two opposing flaps, each flap delineated from a remaining portion of the sheet by a path along which the sheet is scored, so that the flaps, when folded along their respective paths, define a single elevated drinking portion having a spout formed between an extension of the base region and at least one of the two flaps.

27 Claims, 8 Drawing Sheets

Related U.S. Application Data continuation of application No. 12/813,840, filed on Jun. 11, 2010, now Pat. No. 8,505,807.

(60) Provisional application No. 61/186,458, filed on Jun. 12, 2009.

(58) Field of Classification Search

CPC ..... A47G 19/2205; A47G 19/2266; A47G 19/2272

USPC ..... 229/5.5, 125.42, 128, 160.2, 404; 220/710; 222/462, 572, 574

See application file for complete search history.

(56) References Cited

U.S. PATENT DOCUMENTS

| | | | | |
|---|---|---|---|---|
| 1,295,418 | A | 2/1919 | Bohlman | 229/100 |
| 1,375,778 | A | 4/1921 | Clearwater | 229/404 |
| 1,527,830 | A | 2/1925 | Booker | 220/315 |
| 1,543,209 | A | 6/1925 | Fulton | 604/78 |
| 2,016,964 | A | 10/1935 | Huffman | 113/120 |
| 2,074,824 | A | 3/1937 | Karlsson-Ygger | 229/4.5 |
| 2,321,042 | A * | 6/1943 | Preis | B65D 5/727 229/121 |
| 2,344,359 | A | 3/1944 | Lehmann | 229/37 |
| 2,367,780 | A | 1/1945 | Inman | 229/26 |
| 2,608,841 | A * | 9/1952 | Rice | A47G 19/2272 215/11.5 |
| 2,646,200 | A | 7/1953 | Atkins | 229/7 |
| 2,661,138 | A | 12/1953 | Leonard | 229/17 |
| 2,687,840 | A | 8/1954 | Innes | 229/51 |
| 2,797,041 | A | 6/1957 | Rondone | 229/39 |
| 2,812,121 | A | 11/1957 | Sheets | 222/528 |
| D185,882 | S | 8/1959 | Bamburg | 58/12 |
| 2,964,227 | A | 12/1960 | M. Goldsholl | 229/21 |
| 3,047,179 | A | 7/1962 | Madej | 215/73 |
| 3,090,542 | A | 5/1963 | Miller | 229/51 |
| 3,125,258 | A | 3/1964 | Watts | 222/480 |
| 3,150,811 | A | 9/1964 | Amberg | 229/5.5 |
| 3,190,440 | A | 6/1965 | Palmer | 206/45.31 |
| 3,302,858 | A | 2/1967 | Miller | 229/51 |
| 3,315,866 | A | 4/1967 | Kersh et al. | 229/7 |
| 3,334,797 | A | 8/1967 | Latham et al. | 229/7 |
| 3,343,743 | A | 9/1967 | Hamilton, Jr. et al. | 229/21 |
| 3,361,308 | A * | 1/1968 | Rumberger | B65D 5/741 222/528 |
| 3,365,114 | A | 1/1968 | Macchi | 229/38 |
| D219,266 | S | 11/1970 | Biallo | D9/230 |
| 3,595,446 | A | 7/1971 | Hellstrom | 222/213 |
| 3,630,430 | A | 12/1971 | Struble | 229/16 B |
| 3,680,771 | A | 8/1972 | Blunsdon | 229/65 |
| 3,765,594 | A | 10/1973 | Cramphorn | 229/37 |
| 3,806,023 | A | 4/1974 | Barnett | 229/43 |
| 3,809,310 | A | 5/1974 | VanderLugt, Jr. | 229/26 |
| 3,845,897 | A | 11/1974 | Buttery et al. | 229/16 R |
| 3,929,222 | A | 12/1975 | Smith et al. | 206/45.14 |
| 3,964,606 | A | 6/1976 | Hogg et al. | 206/395 |
| 3,971,503 | A | 7/1976 | Allan et al. | 229/38 |
| 4,083,447 | A | 4/1978 | Walters et al. | 206/45.19 |
| 4,135,512 | A | 1/1979 | Godsey | 128/222 |
| 4,150,747 | A | 4/1979 | Gordon | 206/603 |
| 4,185,764 | A | 1/1980 | Cote | 229/16 R |
| 4,201,331 | A | 5/1980 | Austin | 229/39 R |
| 4,238,069 | A | 12/1980 | Morris, Jr. | 229/52 B |
| 4,267,955 | A | 5/1981 | Struble | 229/16 R |
| 4,322,014 | A | 3/1982 | Philip | 220/85 SP |
| 4,368,841 | A | 1/1983 | Eddy | 229/5.5 |
| 4,420,111 | A | 12/1983 | Hament | 229/7 SC |
| 4,535,928 | A | 8/1985 | Capo | 229/16 R |
| 4,564,139 | A | 1/1986 | Reil | 229/5.5 |
| 4,573,631 | A | 3/1986 | Reeves | 229/7 S |
| 4,620,665 | A | 11/1986 | McSherry | 229/43 |
| 4,630,733 | A | 12/1986 | Fear | 206/459 |
| 4,706,874 | A | 11/1987 | Reil | 222/526 |
| 4,711,389 | A | 12/1987 | Alba et al. | 229/1.5 B |
| 4,712,725 | A | 12/1987 | Moore | 229/8 |
| 4,714,164 | A | 12/1987 | Bachner | 206/518 |
| 4,714,190 | A | 12/1987 | Morrocco | 229/1.5 B |
| 4,730,766 | A | 3/1988 | Fear | 229/137 |
| 4,805,775 | A | 2/1989 | Fear | 206/459 |
| 4,886,206 | A | 12/1989 | Martinez | 229/123.1 |
| D306,975 | S | 4/1990 | Brondyke et al. | D9/431 |
| 4,915,235 | A | 4/1990 | Roosa | 206/611 |
| 5,048,749 | A | 9/1991 | Wischusen, III | 229/128 |
| 5,061,501 | A | 10/1991 | Lowe | 426/124 |
| 5,062,568 | A | 11/1991 | Hill et al. | 229/1.5 B |
| 5,137,210 | A | 8/1992 | Hibbs | 229/120.18 |
| 5,301,870 | A | 4/1994 | Smith et al. | 229/1.5 B |
| 5,358,175 | A | 10/1994 | Cai | 229/117.14 |
| 5,400,989 | A | 3/1995 | Gaskill | 248/97 |
| 5,417,364 | A | 5/1995 | Shaw | 229/400 |
| 5,423,476 | A | 6/1995 | Ferrer | 229/404 |
| D367,816 | S | 3/1996 | Cai | D9/431 |
| 5,588,552 | A | 12/1996 | Johnson | 220/712 |
| 5,626,283 | A | 5/1997 | Mellon | 229/120.13 |
| 5,645,191 | A | 7/1997 | Neville | 220/717 |
| 5,676,306 | A | 10/1997 | Lankin et al. | 229/404 |
| 5,697,549 | A | 12/1997 | Yocum | 229/400 |
| 5,711,479 | A * | 1/1998 | Spronk | B65D 5/0272 229/121 |
| 5,720,429 | A | 2/1998 | Cordle | 229/120.18 |
| D406,058 | S | 2/1999 | Allmon | D9/433 |
| 5,875,957 | A | 3/1999 | Yocum | 229/120.22 |
| 5,911,358 | A | 6/1999 | Kenner et al. | 229/116.1 |
| 5,960,987 | A | 10/1999 | Solland et al. | 220/834 |
| 5,979,745 | A | 11/1999 | Surlina | 229/106 |
| 6,019,277 | A | 2/2000 | Lundström | 229/117.05 |
| 6,027,018 | A | 2/2000 | Yocum | 229/400 |
| 6,164,488 | A | 12/2000 | Solland et al. | 220/834 |
| 6,176,420 | B1 | 1/2001 | Sarson et al. | 229/128 |
| 6,216,946 | B1 | 4/2001 | Cai | 229/400 |
| 6,230,969 | B1 | 5/2001 | Spransy | 229/400 |
| D451,385 | S | 12/2001 | Bryan et al. | D9/423 |
| 6,360,944 | B1 | 3/2002 | Gorman | 229/400 |
| D456,253 | S | 4/2002 | Bryan et al. | D9/431 |
| D456,710 | S | 5/2002 | Persson | D9/431 |
| 6,394,338 | B1 | 5/2002 | Sluder | 229/120.15 |
| D467,798 | S | 12/2002 | Cohon | D9/418 |
| D469,691 | S | 2/2003 | Brondyke et al. | D9/431 |
| 6,758,390 | B2 | 7/2004 | Sarson, et al. | 229/128 |
| D495,209 | S | 8/2004 | Tranfaglia et al. | D7/512 |
| D502,364 | S | 3/2005 | Chan | D7/511 |
| 6,955,289 | B2 | 10/2005 | Green | 229/128 |
| D605,895 | S | 12/2009 | Abbott | D7/511 |
| D628,059 | S | 11/2010 | Perkins-Stanaford et al. | D9/418 |
| 2004/0211823 | A1 | 10/2004 | Sarson et al. | |
| 2005/0173507 | A1 | 8/2005 | Green | |
| 2006/0169759 | A1 * | 8/2006 | Sarson | B65D 3/08 229/400 |
| 2009/0114710 | A1 | 5/2009 | Lang | 229/404 |
| 2009/0261156 | A1 | 10/2009 | Abbott | 229/404 |
| 2010/0252424 | A1 | 10/2010 | Amano et al. | |
| 2010/0252524 | A1 | 10/2010 | Dubs et al. | |
| 2013/0056469 | A1 | 3/2013 | Davis et al. | |

FOREIGN PATENT DOCUMENTS

| | | | | |
|---|---|---|---|---|
| GB | 773138 A * | 4/1957 | | B65D 5/0209 |
| GB | 2 380 397 A | 4/2003 | | A47G 19/22 |
| JP | 2003-072733 | 3/2003 | | |
| JP | 2003-072733 | 12/2003 | | |
| JP | 4853603 | 1/2012 | | |
| WO | WO 2005/012114 A1 | 2/2005 | | B65D 3/20 |

OTHER PUBLICATIONS

Authorized Officer Galarraga, J., Serrano, Written Opinion of the International Searching Authority; PCT/US2010/038327, 4 pages, Sep. 14, 2010.

Lance Coleman, "Curious Cup—Louisville Man Invents No-Spill 'Origami' Cup," 20 pages, Sep. 3, 2008; www.blounttoday.com.

(56) References Cited

OTHER PUBLICATIONS

Keith Orchard, The Kiss Cup, *Kiss Cup Photographs* http://www.jovoto.com/contests/drink-sustainably/ideas/5312; 2010, 5 pages.
Korean Intellectual Property Office, Notification of Grounds for Rejection pertaining to Application No. 10-2011-7031716, 6 pages, dated Apr. 20, 2016 [3502/102KR].
Korean Intellectual Property Office (*English Translation*), Notification of Grounds for Rejection pertaining to Application No. 10-2011-7031716, 8 pages, dated Apr. 20, 2016 [3502/102KR].
Korean Intellectual Property Office, Notification of Grounds for Rejection pertaining to Application No. 10-2015-7012255, 7 pages, dated Apr. 20, 2016 [3502/108KR].
Korean Intellectual Property Office (*English Translation*), Notification of Grounds for Rejection pertaining to Application No. 10-2015-7012255, 9 pages, dated Apr. 20, 2016 [3502/108KR].

* cited by examiner

VESSEL AND METHOD FOR MAKING THE SAME

CROSS REFERENCE TO RELATED APPLICATIONS

The present application is a continuation of, and claims priority from, U.S. non-provisional patent application Ser. No. 13/942,916 filed Jul. 16, 2013, and titled "Vessel and Method for Making the Same" and naming Peter Herman as inventor, which claims priority from U.S. non-provisional patent application Ser. No. 12/813,840 filed Jun. 11, 2010 and titled "Vessel and Method for Making the Same" and naming Peter Herman as inventor, issued as U.S. Pat. No. 8,505,807, and from U.S. provisional patent application Ser. No. 61/186,458, filed Jun. 12, 2009, and titled "Vessel and Method for Making the Same" and naming Peter Herman as inventor, all of which are hereby incorporated by reference herein in their entirety.

TECHNICAL FIELD

The present invention relates to vessels and methods of making the same, and more particularly to drinking vessels composed from flexible materials.

BACKGROUND ART

It is known in the prior art to provide disposable liquid containers such as paper cups. These cups are generally coated with a substance that prevents the paper container from absorbing or leaking the liquid contained therein. Furthermore, in the restaurant arena, such as fast food restaurants, coffee shops, etc., a separate lid, for example a plastic lid, is provided as a complement to such cups in order to help prevent spillage of a hot beverage, for example. The lids are often plastic lids and some have an opening for insertion of a straw while others form a narrow opening conducive to direct user consumption.

However, since these cups often come in a variety of sizes, a restaurant or coffee shop will generally be required to stock lids in multiple sizes to complement the variety of cup sizes. Accordingly, providing consumers with a variety of cup sizes in the form of devices known in the prior art requires the use of separate items (i.e. the cup and corresponding lid), generally made of different materials and further requires coordination and assembly of these items prior to serving a patron. Furthermore, more organizations are on a quest to provide more environmentally safe products such as 100 percent recyclable cups, which may be harder to facilitate with cups made of different materials than their corresponding lids.

SUMMARY OF THE INVENTION

In a first embodiment of the invention there is provided a vessel that includes a sheet of flexible material, cut, rolled, and affixed to form a frusto-conically shaped base region. The sheet, when rolled, also includes an upper region having two opposing flaps. Each flap is delineated from a remaining portion of the sheet by a path along which the sheet is scored. The flaps, when folded along their respective paths, define a single elevated drinking portion having a spout formed between an extension of the base region and at least one of the two flaps.

One of the two flaps may be an outer flap and the other flap may be an inner flap such that the outer flap overlies the inner flap when the two flaps are folded. The outer flap has a first edge shaped to coincide, when the flaps are folded, approximately with the path of scoring in the inner flap. The outer flap may also include a closure tab formed as part of the sheet. The closure tab protrudes from a scored line along the first edge of the outer flap. The scored line permits the closure tab to be folded to overlie a portion of the base region. The closure tab may also be removably attachable to the portion of the base region and may include an adhesive layer.

The inner flap includes a second edge shaped to coincide, when the flaps are folded, approximately with the path of scoring in the outer flap. The inner flap optionally includes an opening tab formed as part of the sheet. The opening tab protrudes from a second scored line along the second edge of the inner flap. The second scored line permits the opening tab to be folded along the second line to protrude upwardly from a plane of a surface of the inner flap. The upwardly protruding opening tab facilitates unfolding of the inner flap after it has been folded.

The outer flap and the inner flap are also shaped to define, when the flaps are folded, a vent opening in an upper region of the vessel opposite the spout.

In a related embodiment, the vessel includes a bottom formed from a second sheet of material, affixed in an opening of the base region, to enable the vessel to retain a liquid placed therein via an opening in the upper region existing when the flaps are unfolded. The bottom is generally circular. The bottom may be formed from material that is a part of the first sheet of material. The bottom may also be folded into a circular flat-bottomed surface having a circumferential wall wherein the circumferential wall is adhered to an interior portion of the base region.

In another related embodiment, the vessel includes a dam disposed on at least one of the opposing flaps to restrain contents of the vessel from flowing between the flaps and escaping from the vessel. The dam may include at least one engaging pair of embossments in the material of the flaps. The dam may include a bead of a second material.

Another embodiment of the present includes a vessel having a frusto-conical portion and a covered spout. The frusto-conical portion and the spout are formed from a single sheet of material. The covered spout is formed by folding a pair of flaps constituting a part of the sheet and the vessel is stackable when the flaps are unfolded.

Another embodiment of the present invention includes a method of making a vessel that includes cutting a sheet of flexible material, scoring, rolling and gluing the sheet into a vessel having a frusto-conically shaped base region. The vessel will also include an upper region having two opposing flaps. Each flap is delineated from a remaining portion of the sheet by a path along which the sheet is scored. The flaps, when folded along their respective paths, define a single elevated drinking portion having a spout formed between an extension of the base region and at least one of the two flaps.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

Definitions. As used in this description and the accompanying claims, the following terms shall have the meanings indicated, unless the context otherwise requires:

To "affix" a sheet of material is to form a connection between that sheet and another surface. Such a connection may be created using an adhesive layer applied between overlapping portions, or spanning adjacent portions, of the sheet and the other surface being connected. The connection may alternatively, or in addition, be achieved by crimping, fusing, or welding of the sheet to the other surface, under conditions, for example, including the application of one or more of pressure and heat.

A "covered spout" of a vessel is a spout formed by material of the vessel defining and completely surrounding an aperture, so that when the spout is inserted in the mouth of a user in use of the vessel for drinking, the lips of the user may come into contact with the material over a full 360-degree angular extent of the material disposed around the periphery of the aperture.

A "frusto-conical" shape includes a shape similar to a frustum of a cone, including, for example, a pyramidal section having rounded edges, so as to approximate a frustum of a cone.

Figure 1:
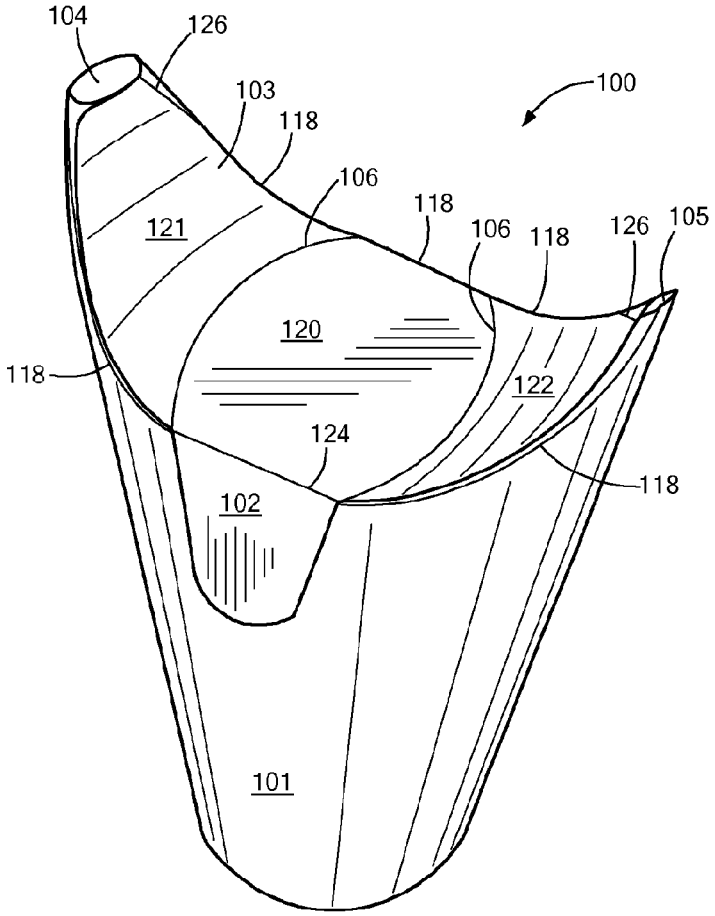
FIG. 1 is a perspective view of a drinking vessel in a closed configuration in accordance with an embodiment of the present invention.

FIG. 1 is a perspective view of a drinking vessel in a closed configuration in accordance with an embodiment of the present invention. The drinking vessel 100 illustrated in FIG. 1 is characterized by a frusto-conical base 101. The frusto-conical base allows the user to grasp vessel 100 in a comfortable manner and allows the vessel to be easily maintained within a cup holder, for example within an automobile. Vessel 100 includes a top or cover formed from two overlapping flaps. In the current view, flap 103 is visible since it is the outer flap in this embodiment. The vessel has an elevated drinking portion that includes a drinking spout 104. The overlapping flaps form a portion of drinking spout 104. The drinking spout is configured so that when the spout is inserted in the mouth of a user in use of the vessel for drinking, the lips of the user may come into contact with the material over a full 360-degree angular extent of the material disposed around the periphery of the aperture. The spout allows the user to easily drink from the cup, but helps prevent spillage of a beverage contained in the vessel. Unlike a traditional gable top milk carton, such as that provided in U.S. Pat. No. 2,826,349 which can be opened to form a spout for pouring, the vessel of the current invention is designed so that a user may completely surround the aperture in the spout with her lips when consuming the contents of the vessel.

The overlapping flaps also form a portion of an air relief aperture 105. Flap 103 includes a closing tab 102 in this embodiment. Closing tab 102 is formed as an integral part of the sheet from which the vessel is formed and protrudes from an edge of flap 103. The sheet includes a scored line 124 at the intersection of closure tab 102 and flap 103 to facilitate folding of the tab. The tab may include an adhesive on the side adjacent to the base when folded in order to help maintain the cover in a closed configuration.

Flap 103 also includes central score lines 106 and straight outlying score lines 126 in this embodiment. Central score lines 106 may be preformed into flap 103 in order to facilitate folding the flap into a closed configuration that accommodates the geometry of the vessel. In particular, the central score paths 106 delineate a relatively planar region 120 therebetween, and paths 106 delineate ascending regions 121 and 122 outside of flat region 120.

When flap 103 is folded into the closed position, tab 102 will overlie a portion of the base region. In an embodiment wherein the tab includes an adhesive, the tab will adhere to the portion of the base region that it overlies. The adhesive on the tab will have a level of tackiness that allows the tab to remain connected to the base region of the vessel when pressed against the base. However, the adhesive will also allow the tab to be released upon application of sufficient force by a user.

The vessel demonstrated in FIG. 1 will generally be made of a flexible material such as paper. However, other embodiments may be provided in which the vessel is composed of other flexible materials that are suitable for forming into a vessel that is capable of containing liquids and has a structure similar to vessel 100. In embodiments where the vessel is composed of a material such as paper, the vessel may be coated on one or both sides with a waterproofing coating such as wax or polyethylene. Furthermore, the coating may be applied before or after the vessel is formed from a blank.

Figure 2:
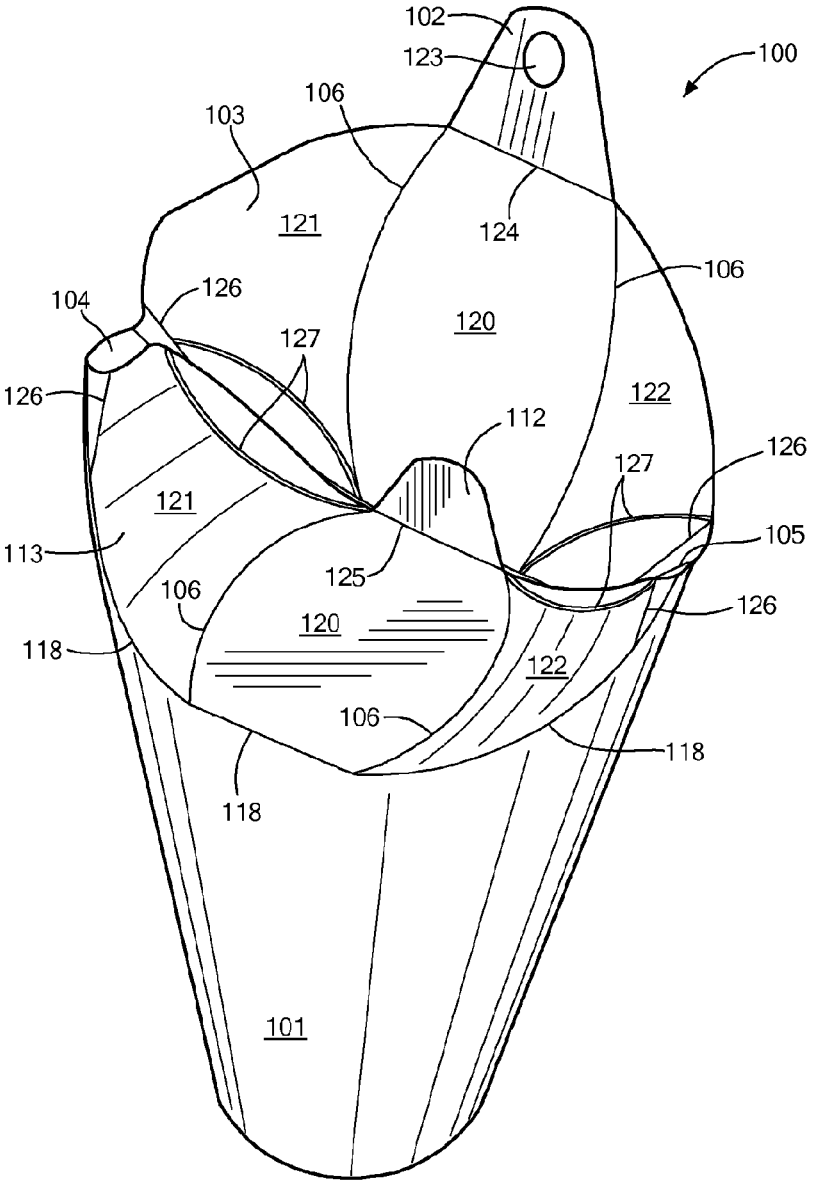
FIG. 2 is a perspective view of the drinking vessel of FIG. 1 with one flap open and one flap closed.

FIG. 2 is a perspective view of the drinking vessel of FIG. 1 with one flap open and one flap closed. FIG. 2 further demonstrates how the flaps overlap one another. In FIG. 2 flap 103 is unfolded and flap 113 is folded. As illustrated, flap 113 may also include a tab 112. Tab 112 facilitates re-opening flap 113 after flap 113 has been folded down into a closed position. Tab 112 prevents the need to grasp the edge of flap 113 that is adjacent to unfolded flap 103 when attempting to open flap 113. To open flap 113 a user simply grasps and pulls extended tab 112, which is folded along path 125.

The formation of drinking spout 104 and air relief aperture 105 are further demonstrated in FIG. 2. Flaps 103 and 113 each form a portion of both drinking spout 104 and air relief aperture 105. Drinking spout 104 and air relief aperture 105 are opposite one another in the upper region of the vessel. Accordingly, tilting vessel 100 for consumption of a beverage contained therein through spout 104, moves the beverage away from the air relief aperture, thereby lowering the possibility that liquid will flow through the air relief aperture while a user is consuming the contents of the vessel. In some embodiments, the vessel may include a cover for drinking spout 104.

Each of flaps 103 and 113 may include a dam 127 on either or both the drinking spout end of the flap and the air relief end of the flap. The dam assists in preventing contents of the vessel from migrating between the flaps and escaping from the vessel. Such migration may be caused by sloshing of the contents in the course of moving the vessel or merely by using of the spout for drinking from the vessel. Dams 127 may be formed by adhering a continuous or dashed bead of a separate material, which may be biodegradable, such as polylactic acid or polylactide, to one or both flaps to cause adhesion of the flaps to one another or at least to provide an impediment to flow of contents between the flaps. Alternatively, dams 127 may be created using at least one engaging pair of embossments in the surface of the flap material along a path. For example, one or more protuberances or impressions or both may be embossed in the material of the flaps along such a path, by stamping, scoring or other methods used to raise or lower the surfaces of the material. The embossments may be designed so that a hill in one flap nestles into a valley of the other flap. Alternatively, or even in addition, embossments may be provided so that a hill in one flap is immediately adjacent to a hill in the other flap. In each case the embossments are engaged with one another. Furthermore, the protuberances and impressions may be formed in a staggered pattern of circular or other geometrical shapes or a single shape that extends the entire length of the path demonstrated by dam 127. A dam created by altering the surface of the flap material, or made using a separate bead of material, may be formed in a complimentary fashion on flaps 103 and 113 such that when the flaps are overlapped into the closed configuration demonstrated in FIG. 1 the formations interlock with one another.

Figure 3:
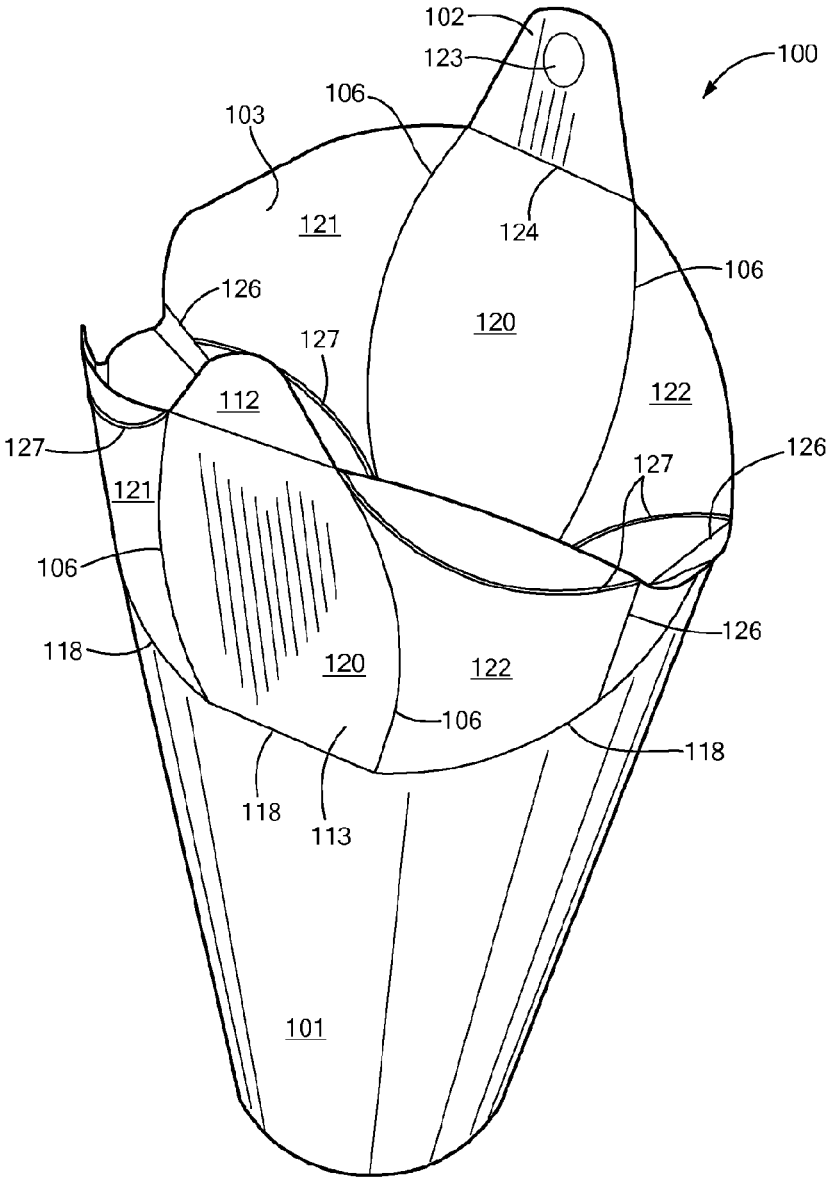
FIG. 3 is a perspective view of the drinking vessel of FIG. 1 in an open configuration.

FIG. 3 is a perspective view of the drinking vessel of FIG. 1 in an open configuration. Vessel 100 has both flaps 103 and 113 in unfolded positions in FIG. 3. The flaps, which oppose one another, are more clearly seen in this configuration as an integral part of the vessel walls. Each flap extends directly from the frusto-conical base portion 101. As shown, tabs 102 and 112 of each respective flap may incorporate a distinct shape in some embodiments. The distinction may signal which flap should be folded first or which flap is the interior flap and which is the exterior flap. Such a signal may incorporate the use of some additional indicia or marking on the tabs or flaps.

When both of the flaps of the vessel are unfolded, as illustrated in FIG. 3, successive vessels may be stacked on one another. Such stacking permits compact storage of a large number of vessels and facilitates easily retrieving a single vessel from such a stack.

Figure 4:
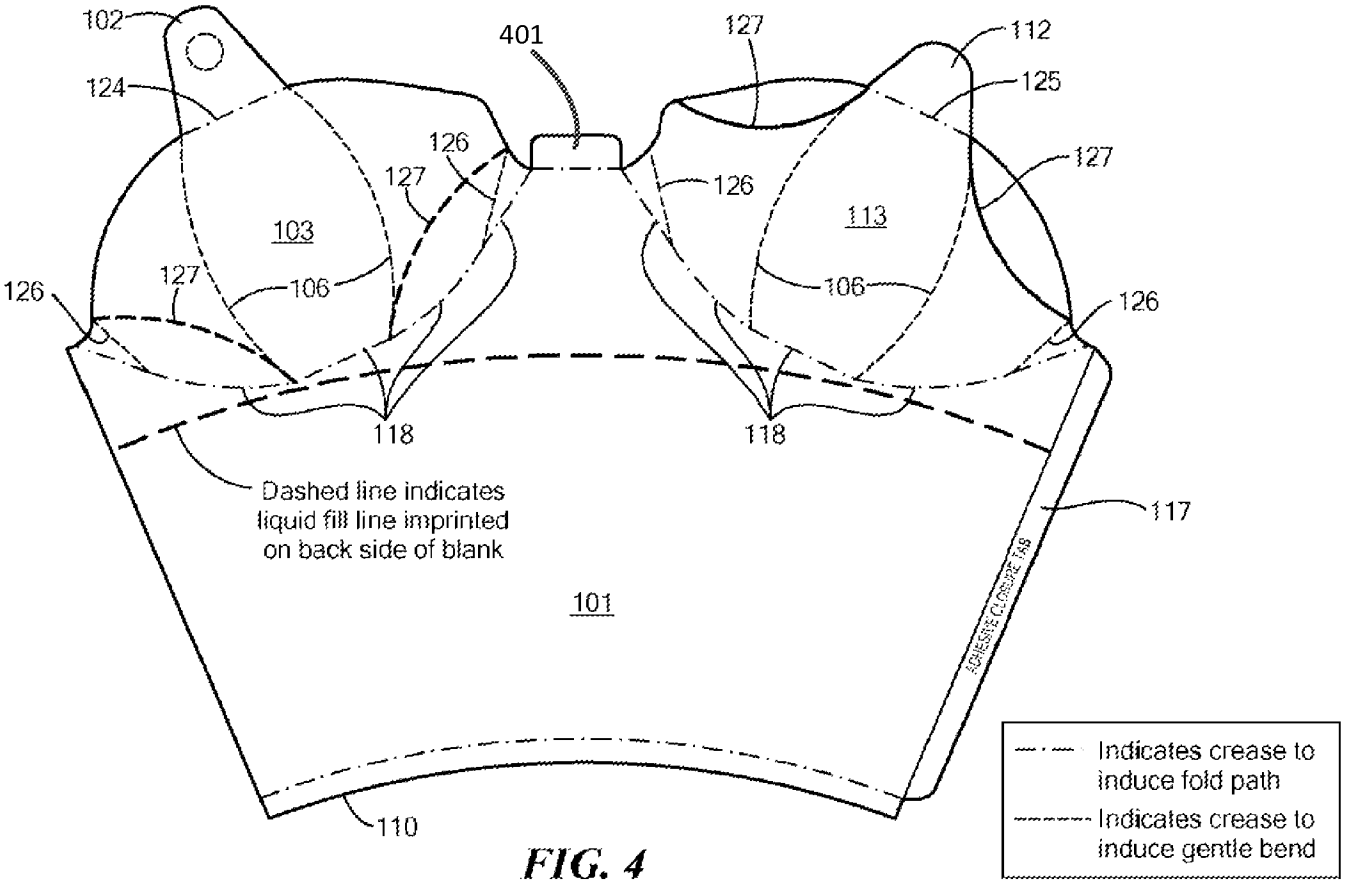
FIG. 4 illustrates a sheet of flexible material used to form the drinking vessel of FIG. 1.

FIG. 4 illustrates a sheet of flexible material used to form the drinking vessel of FIG. 1. As illustrated, the outline of the vessel is an asymmetric design formable into a vessel, having a frusto-conical shape with a flat bottom, and which also includes a top. To form the vessel, the outline may be cut along the periphery, scored along paths 118, 106, and 126, rolled, and affixed. In the illustrated embodiment, the outline includes a tab 117. Tab 117 is secured to the opposing edge of the outline when the outlined vessel 100 is removed from the sheet and is rolled or formed into the configuration demonstrated in FIG. 1. The tab may include an adhesive layer for attaching the tab in a manner that forms a leak free barrier. The bottom edge 110 of the outline forms the base of the vessel 100. Edge 110 is in the shape of an ellipse, which allows the vessel to have a substantially flat base when formed. Paths 106, 118, and 126 may be scored prior to formation of the vessel to guide folding of the vessel into the proper configuration. When the vessel is rolled and the flaps are both closed, the outer edge of each flap coincides with the scored path 118 on the opposing flap. Tab 401 folds down to reinforce the spout 104.

Figure 5:
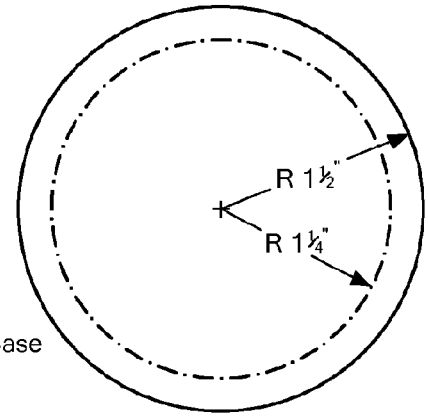
FIGS. 5-7 illustrate different sized bottoms for the drinking vessel of FIG. 1.
Figure 6:
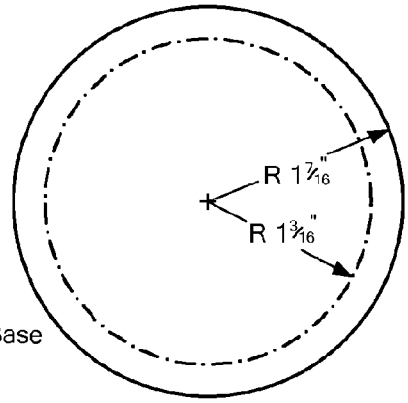
Figure 7:
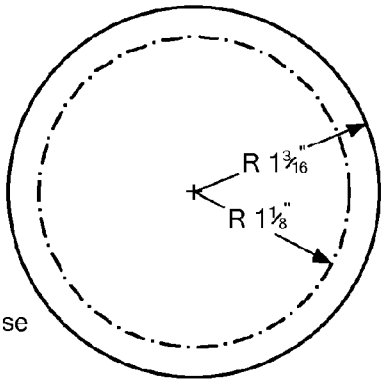

FIGS. 5-7 illustrate different sized bottoms for the drinking vessel. The bottom, generally circular, may have a different diameter based on the dimensions of the vessel. For example, to increase the volume of the vessel the dimensions may be altered and the bottom may have a larger diameter. FIG. 5 illustrates a bottom for a 12 oz. vessel, while FIGS. 6 and 7 illustrate bottoms for 10 and 8 oz vessels respectively. The bottom of the vessel may be affixed in the opening in the lower region of the frusto-conical base portion 101 when the sheet is rolled. This enables the vessel to retain a liquid placed therein via an opening in the upper region of the vessel when the flaps are unfolded. In some embodiments, the bottom may be a part of the same sheet forming the vessel.

Figure 8:
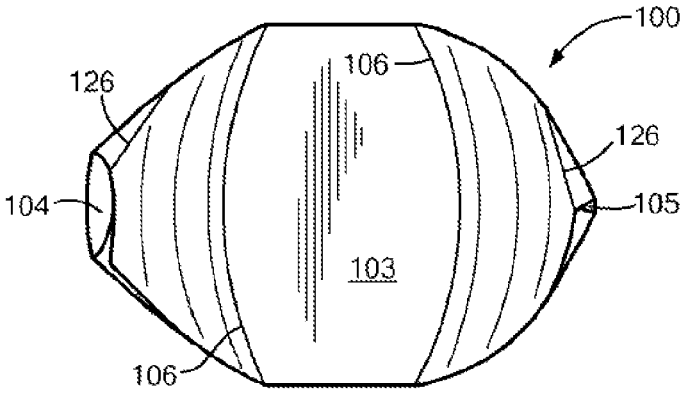
FIG. 8 is a top view of the drinking vessel of FIG. 1.

FIGS. 8-13 illustrate different views of the drinking vessel of FIG. 1. FIG. 8 is a top view of the drinking vessel. In this figure the drinking spout 104 and the air relief aperture 105 are visible. As demonstrated, the drinking spout and the air relief aperture are located at opposing extremities of vessel 100 and are formed from the folding flaps, of which flap 103 is visible. The folded flaps also form an integral cover for vessel 100. The scored paths 106 of each flap are substantially aligned with the scored paths 106 of the opposing flap when the flaps are folded close.

Figure 9:
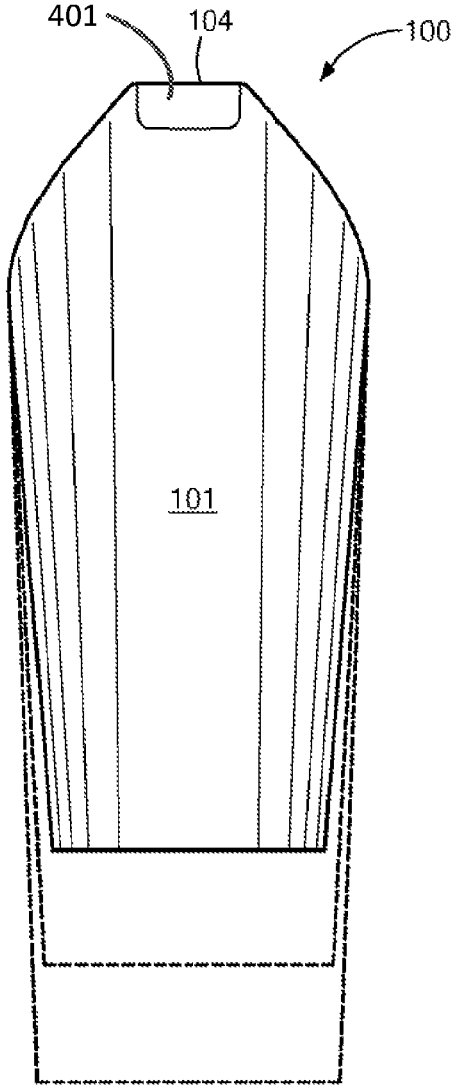
FIG. 9 is a front view of the drinking vessel of FIG. 1.

FIG. 9 is a front view of the drinking vessel. The front in this description refers to the side having the elevated drinking portion and the drinking spout 104. Furthermore, FIG. 9 demonstrates sample dimensions for adapting the vessel to alternative volumes. The adaptations include an alteration in the length of the sidewalls of the container and the diameter of the bottom. FIG. 9 also schematically illustrates fold-down tab 401 which reinforces the spout.

Figure 10:
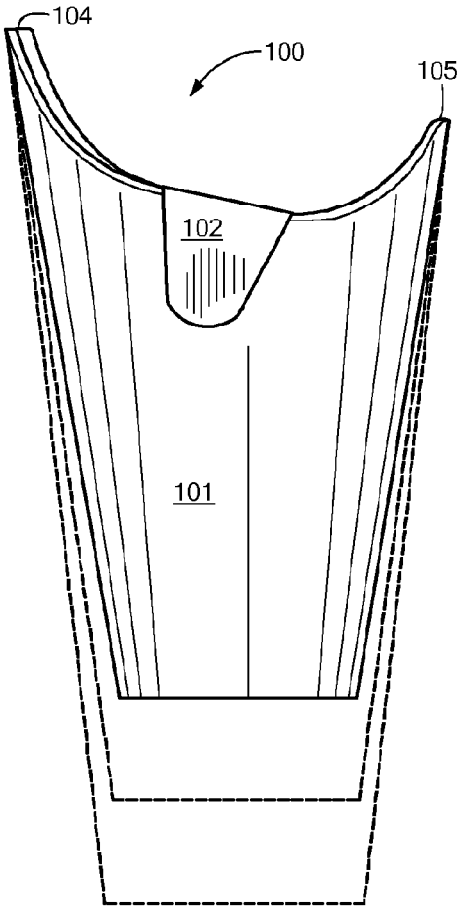
FIG. 10 is a side view of the drinking vessel of FIG. 1.
Figure 12:
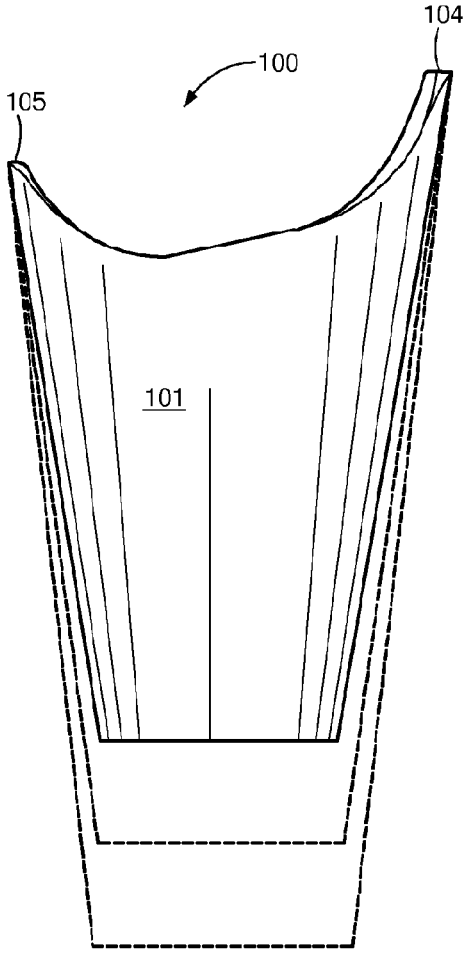
FIG. 12 is another side view of the drinking vessel of FIG. 1.

FIG. 10 is a side view of the drinking vessel of FIG. 1. The side view illustrated in this figure shows the vessel from the side with tab 102 of the outer flap on the outside of the vessel. As further illustrated in this profile view, the drinking spout 104 is formed similar to cups that facilitate sipping a beverage through a narrow opening. FIG. 12 is another side view of the drinking vessel 100 from the side opposite the side shown FIG. 10.

Figure 11:
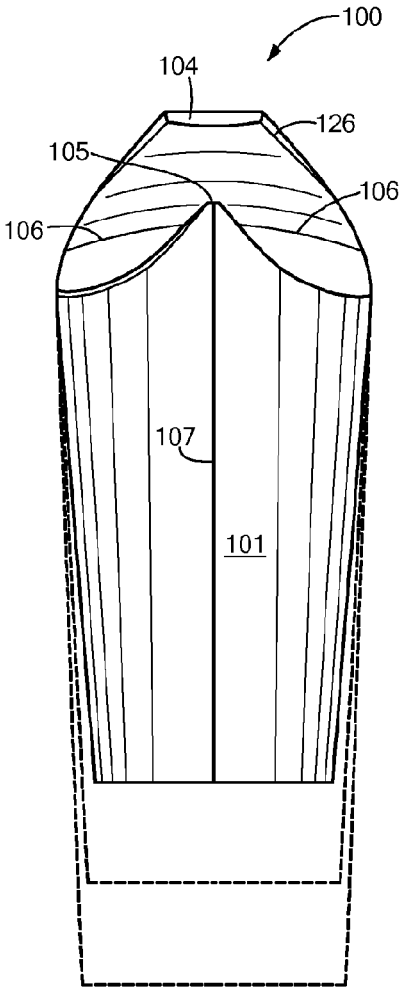
FIG. 11 is back view of the drinking vessel of FIG. 1.

FIG. 11 is back view of the drinking vessel of FIG. 1. In the embodiment illustrated, the air relief aperture 103 is at a lower elevation, relative to the base of the vessel, than the drinking spout 104. Furthermore, seam 107, as shown in the illustration, represents the overlap of tab 117, shown in FIG. 4, with the opposing edge of vessel 100.

Figure 13:
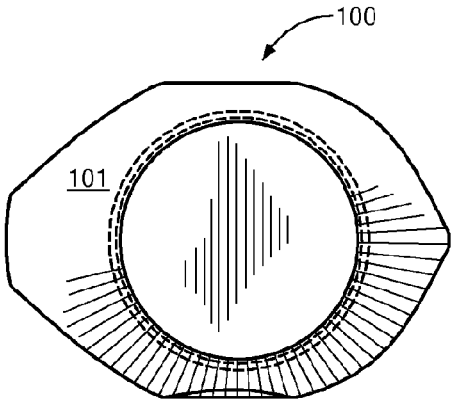
FIG. 13 is a bottom view of the drinking vessel of FIG. 1.

FIG. 13 is a bottom view of the drinking vessel of FIG. 1. Once a bottom is secured to the opening in the base region 101 of vessel 100, for example by gluing, the vessel will be able to contain liquids placed therein without leakage.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A spouted cup for holding and dispensing substances, the cup comprising:

a base region comprising an inner surface sidewall and having an opening at a lower end thereof;

a bottom secured in that opening;

a first flap extending from the base region, the first flap having a first curved edge and comprising a first spout-forming region;

a second flap extending from the base region, the second flap having a second curved edge and comprising a second spout-forming region, the first flap and the second flap configured such that, when the flaps are folded:

the first flap overlies that base region, such that:

at least a portion of the first curved edge is in physical contact with an opposing portion of the inner surface sidewall of the base region; and the second flap overlies the base region, such that:

at least a portion of the second flap overlaps at least a portion of the first flap;

such that at least a portion of the second spout-forming region overlies at least a portion of the first spout-forming region, so as to form a spout extending to a first height above a bottom edge of the base region and at least one of the first flap and the second flap comprises a dam configured to restrain contents of the vessel from flowing between the flaps and escaping from the cup when the flaps are folded.

2. The spouted cup according to claim 1, wherein:

the first flap further comprises a first vent-forming region; and the second flap further comprises a second vent-forming region, such that, when the flaps are folded:

at least a portion of the second vent-forming region overlies at least a portion of the first vent-forming region so as to form a vent extending to a second height above the bottom edge of the base region, the first height being greater than the second height.

3. The spouted cup according to claim 1, wherein at least a portion of the first curved edge is in physical contact with an opposing portion of the second flap as the first curved edge and the second flap extend to the first height above the bottom edge of the base region.

4. The spouted cup according to claim 1, wherein the second flap includes a closure tab scored along a first line wherein it protrudes from the second curved edge, to permit the closure tab to be folded along the first line so as to overlie a portion of the base region.

5. The spouted cup according to claim 4, wherein the closure tab is removably attachable to the portion of the base region.

6. The spouted cup according to claim 1, wherein the first flap includes an opening tab protruding from the first curved edge, and scored along a second line wherein it protrudes from the first curved edge, to permit the opening tab to be folded along the second line so as to protrude upwardly from a plane of a surface of the first flap, to facilitate unfolding of the first flap after it has been folded.

7. The spouted cup according to claim 1, wherein the dam includes at least one engaging pair of embossments in the material of the flaps.

8. The spouted cup according to claim 1, wherein the dam includes a bead of a second material.

9. The spouted cup according to claim 1, wherein the cup is configured to hold and dispense a liquid.

10. The spouted cup according to claim 1, wherein the second flap completely overlaps the first flap.

11. The spouted cup according to claim 1, further comprising a single cover member extending from the base region, the single cover member comprising the first flap and the second flap, and a coupling region extending between the first spout-forming region and the second spout-forming region, wherein the first spout-forming region, the second spout-forming region, and the coupling region form a covered drinking spout.

12. A spouted cup configured to contain liquid content, comprising:

a flexible waterproof material shaped to define a side wall of a frusto-conical base region having an opening at a lower end thereof;

a bottom secured in the opening such that the side wall and the bottom form a container so that the cup is configured to contain liquids; and a pair of opposing flaps including an inner flap and an outer flap, of the flexible material, extending from an upper end of the base region, each flap delineated from the base region by a corresponding curved scored path, so that the flaps, when folded along their respective paths, are configured such that:

at least a portion of an outer edge of the inner flap coincides with at least a portion of the scored path of the outer flap; and the flaps are adapted to define an elevated drinking portion having an aperture-containing spout, formed between an extension of the base region and at least one of the two flaps; and the outer flap includes a closure tab protruding from an outer edge thereof, the closure tab scored along a first line wherein it protrudes from the outer edge to permit the closure tab to be folded along the first line so as to overlie a portion of the base region; wherein the closure tab includes an adhesive layer.

13. The spouted cup according to claim 12, wherein the flaps are also shaped to define, when the flaps are folded, a vent in an upper region of the vessel opposite the spout.

14. The spouted cup according to claim 12, wherein the closure tab is removably attachable to the portion of the base region.

15. The spouted cup according to claim 12, wherein the inner flap includes an opening tab protruding from its outer edge and scored along a second line wherein it protrudes from its outer edge, to permit the opening tab to be folded along the second line so as to protrude upwardly from a plane of a surface of the inner flap, to facilitate unfolding of the inner flap after it has been folded.

16. The spouted cup according to claim 12, wherein at least one of the opposing flaps comprises a dam configured to restrain contents of the vessel from flowing between the flaps and escaping from the cup when the flaps are folded.

17. The spouted cup according to claim 16, wherein the dam includes at least one engaging pair of embossments.

18. The spouted cup according to claim 16, wherein the dam comprises a biodegradable material.

19. The spouted cup according to claim 16, wherein the dam causes adhesion of the flaps to one another.

20. The spouted cup according to claim 12, further comprising a tab configured to fold down to reinforce the spout.

21. A spouted cup adapted to hold and dispense liquids, the cup comprising:

a flexible material shaped to define a side wall of a frusto-conical base region having an opening at a lower end thereof;

a bottom secured in the opening such that the side wall and the bottom form a container;

an inner flap extending from an upper end of the base region, the inner flap having a first curved edge and comprising a first spout-forming region;

an outer flap extending from the upper end of the base region, the outer flap having a second curved edge and comprising a second spout-forming region, the inner flap and the outer flap configured such that, when the flaps are folded:

at least a portion of the first curved edge is in physical contact with an opposing portion of the vessel wall of the base region; and at least a portion of the outer flap overlaps at least a portion of the inner flap, the inner flap and the outer flap adapted such that at least a portion of the second spout-forming region overlies at least a portion of the first spout-forming region, and are adapted to form a spout having an aperture, the spout extending to a first height above a bottom edge of the base region.

22. The spouted cup according to claim 21, wherein at least one of the inner flap and the outer flap comprises a dam configured to restrain contents of the vessel from flowing between the flaps and escaping from the cup when the flaps are folded.

23. The spouted cup according to claim 21, wherein:

the inner flap further comprises a first vent-forming region; and the outer flap further comprises a second vent-forming region, such that, when the flaps are folded, at least a portion of the second vent-forming region overlies at least a portion of the first vent-forming region so as to form a vent extending to a second height above the bottom edge of the base region, the first height being greater than the second height.

24. The spouted cup according to claim 21, wherein, when the flaps are folded, at least a portion of the first curved edge is in physical contact with an opposing portion of the outer flap as the first curved edge and the outer flap extend to the first height above the bottom edge of the base region.

25. The spouted cup according to claim 21, further comprising a tab disposed between the two flaps and configured to fold down to reinforce the spout.

26. The spouted cup according to claim 21, further comprising a single cover member extending from the base region, the single cover member comprising the inner flap and the outer flap, and an extension of the base region extending between the first spout-forming region and the second spout-forming region, wherein, when the flaps are folded, the first spout-forming region, the second spout-forming region, and the extension of the base region form a covered drinking spout.

27. The spouted cup according to claim 26, wherein the extension of the base region further comprises a tab disposed between the two flaps and configured to fold down to reinforce the spout.

* * * * *